United States Patent [19]

Templeton et al.

[11] Patent Number: 5,019,678

[45] Date of Patent: May 28, 1991

[54] FLUID FLOW SWITCHES WITH LOW FLOW RESISTANCE

[75] Inventors: Robert D. K. Templeton, Ayr; William W. Arnott, Ayrshire, both of Scotland

[73] Assignee: Gentech International Limited, Ayrshire, Scotland

[21] Appl. No.: 404,891

[22] Filed: Sep. 8, 1989

[51] Int. Cl.[5] ..... H01H 35/38; H01H 35/40

[52] U.S. Cl. ..... 200/81.9 M; 73/745; 200/82 E

[58] Field of Search ..... 307/118; 338/32 H; 335/205; 73/239, 744, 745, 861.54; 200/82 E, 81.9 M; 340/606, 611, 626

[56] References Cited

U.S. PATENT DOCUMENTS

| | | | |
|---|---|---|---|
| 4,213,021 | 7/1980 | Alexander | 200/81.9 M |
| 4,581,941 | 4/1986 | Obermann | 338/32 H |
| 4,763,114 | 8/1988 | Eidsmore | 200/82 E |
| 4,792,651 | 12/1988 | Whiting | 73/745 |
| 4,843,886 | 7/1989 | Koppers | 338/32 H |

FOREIGN PATENT DOCUMENTS

| | | |
|---|---|---|
| 1360225 | 10/1972 | United Kingdom . |
| 1496601 | 8/1976 | United Kingdom . |
| 1604247 | 5/1978 | United Kingdom . |
| 2063565 | 6/1981 | United Kingdom . |
| 2173344 | 10/1986 | United Kingdom . |
| 2189648 | 10/1987 | United Kingdom . |
| 2195768 | 4/1988 | United Kingdom . |
| 2198883 | 6/1988 | United Kingdom . |

*Primary Examiner*—Gerald P. Tolin

*Attorney, Agent, or Firm*—Renner, Otto, Boisselle & Sklar

[57] ABSTRACT

A flow switch includes a movable shuttle enclosed within a bore having narrower and wider bore sections. The shuttle has a solid cylindrical portion and a vaned portion. When there is no fluid flow from the inlet to the outlet, the shuttle rests on a part-conical portion of the bore. When fluid pressure is applied at the inlet, the shuttle is raised until the vaned portion is partly within the wider bore section. Fluid can then flow through the spaces between the vanes in the vaned portion, and fluid flow is detected by the change in position of the shuttle. The shuttle can be made magnetic, whereupon a magnetic sensing means such as a magnetic reed switch can be used to detect fluid flow. This arrangement has the advantage that resistance to flow and pressure drop are minimal compared to previous designs.

10 Claims, 2 Drawing Sheets

FLUID FLOW SWITCHES WITH LOW FLOW RESISTANCE

BACKGROUND OF THE INVENTION

1. Field of the Invention

This invention relates to flow switches, that is to switches for detecting flow of a fluid.

2. Description of the Prior Art

In certain applications, it is necessary to detect that a fluid such as a liquid is flowing and to provide an electrical signal dependent thereon. One such application is in shower systems having a pump for providing sufficient pressure to operate the shower, in installations providing an inadequate head of water. Depending on whether the pump is operating or not, and whether or not the water tap has been opened, flow of water may or may not be taking place, and it is necessary to provide an indication of flow to ensure proper control and to prevent possible damage to the installation.

It has been proposed to provide a flow switch in the form of a housing within which a magnetized float member can move between one position in which flow is either not occurring or is being initiated from an undesired direction, and another position to which the float member is moved by fluid flow from a desired direction, the other position allowing fluid flow through the flow switch. A magnetically-responsive switch, such as a reed switch is positioned to detect the position of the float member such that a flow detect signal is provided when the float member is in the other position. Examples of such flow switches are disclosed in UK Pat. Nos. 1 360 225, 1 496 601 and 1 604 247.

A problem with the previously-proposed flow switches is that the design has led to the float member and corresponding parts of the internal bore of the flow switch providing a significant obstruction to the fluid flow. This is particularly disadvantageous since, in many applications of the flow switch, the source of fluid pressure may be unreliable and periodically insufficient; in such a case, it is clearly undesirable to cut down the available pressure still further by obstruction of whatever flow could otherwise be obtained.

Another problem with some previously-proposed flow switches is that the design effectively provides a seal against reverse flow, the float member seating against a corresponding surface of the bore. Whereas in general it is not required for the flow switch to allow a substantial fluid flow in the reverse direction, in many applications it should be possible for fluid to return to the inlet side of the flow switch, in other words a certain degree of fluid seepage should be permitted. Otherwise, for example, a column of water may be trapped above a vertically-disposed flow switch which is closed, and if this column of water is tall enough, it will affect operation of the float member on which it is acting.

UK patent application Ser. No. 2 189 648 A discloses an offset-type flow switch in which the inlet and outlet passages are not collinear. The float member is disposed in an extension of the inlet passage and moves as a result of fluid pressure to expose a slot between the inlet and outlet passages. The offset nature of the arrangement means that the flow switch cannot readily be incorporated in an existing installation. The inlet and the outlet connections must be provided in a correspondingly offset manner.

SUMMARY OF THE INVENTION

It is an object of the invention to provide a flow switch which can overcome the above problems arising in the prior art arrangements.

According to the present invention there is provided a flow switch comprising:

a body with a bore extending therethrough, the bore having relatively narrower and wider sections;

a member movable within the narrower and wider sections of the bore such that the member is a relatively close fit in the narrower bore section, the member having a first portion which permits only limited fluid flow in the close fit clearance between the first portion and the narrower bore section, and a second portion having a flow bypass arrangement whereby substantial fluid flow is possible with the second portion located in the narrower bore section, the member being movable by fluid flow from a closed position to an open position, wherein in the closed position, both the second portion and at least part of the first portion are within the narrower bore section, whereas in the open position, the first portion and a part of the second portion are within the wider bore section thereby allowing fluid to flow; and means for detecting whether the member is in the open position or the closed position.

In a preferred embodiment of the invention, to be described in greater detail hereinafter, the bore sections and the member are both generally cylindrical, with the first portion being a solid cylinder and the second portion being a solid cylinder of reduced diameter, vanes or fins making up the difference to the diameter of the first portion; thus the flow bypass arrangement is constituted by vanes of the second portion of the member, since fluid can flow through the spaces between the vanes.

The detecting means is preferably a magnetic arrangement, such as a reed switch or a Hall-effect sensor. In that case, the member is either made of magnetised material or incorporates a separate magnet within it. However, other detecting means such as capacitive sensors, optical detectors or the like may be used instead.

The above, and other objects, features and advantages of this invention will be apparent from the following detailed description of illustrative embodiments, which is to be read in connection with the accompanying drawings.

DESCRIPTION OF THE PREFERRED EMBODIMENT

Figure 1:
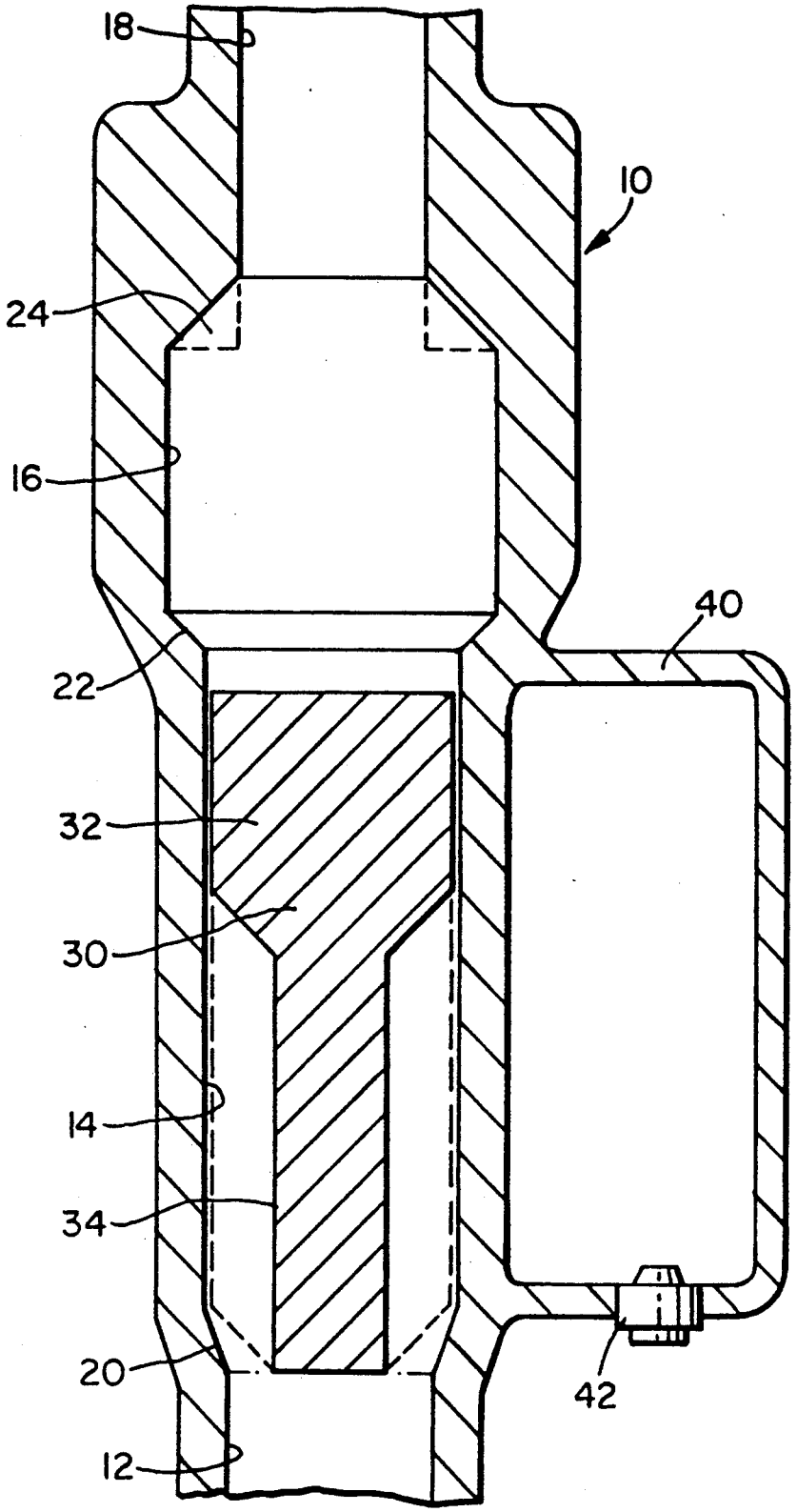
FIG. 1 is a cross-sectional view through a flow switch according to an embodiment of the invention, the flow switch being in a closed state.
Figure 2:
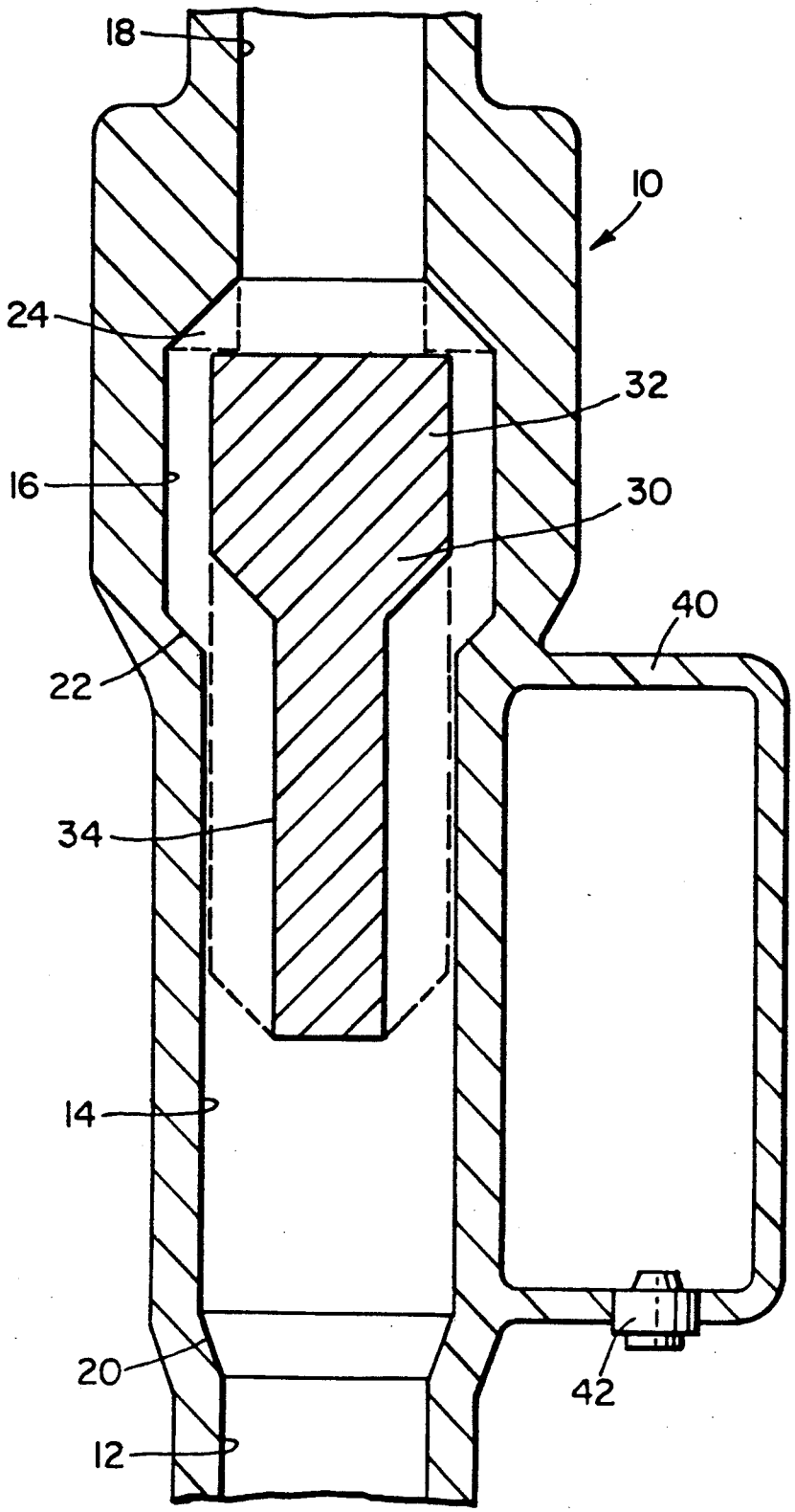
FIG. 2 is a cross-sectional view similar to that of FIG. 1, but with the flow switch in an open state.

Referring to FIGS. 1 and 2, a flow switch according to an embodiment of the invention comprises a body 10 having a bore made up of first to fourth sections 12, 14, 16, 18, the first section 12 defining an inlet, the second and third sections 14, 16 defining a shuttle housing area, and the fourth section 18 defining an outlet. The first and fourth sections 12, 18 are preferably of the same internal diameter, which may typically be equal to the internal diameter of the piping system being used, for example 15 mm copper pipe. The second section 14 has a larger internal diameter, and the third section 16 has a still larger internal diameter. The first and second sections 12, 14 have a connecting portion 20 of part-conical section; similarly, the second and third sections 14, 16 also have a connecting portion 22 of part-conical section. Finally, the third and fourth sections 16, 18 have a baffled connection portion 24 which includes a restriction of part-conical section with baffle parts projecting into the bore so as to form a shuttle retaining means. The body 10 may be formed of a suitable metal, plastics material or the like.

A shuttle 30 is housed within the second and third sections 14, 16 of the bore. The shuttle 30 includes a solid cylindrical section 32 and a vaned section 34. The vaned section 34 is formed of a solid cylindrical section of reduced diameter with a number of (for example, four, six or eight) vanes or fins extending from the reduced-diameter solid cylindrical section. Preferably the dimensions of the vanes are such that the effective diameter of a circle forming a locus of the vaned section 34 is the same as the diameter of the solid cylindrical section 32. The shuttle 30 is either made of magnetized material or else includes within its body an internal magnet.

A detector housing 40 is mounted on the outside of the body 10, preferably adjacent the second section 14 of the bore, as shown. The detector housing 40 includes a magnetic sensing means, such as a reed switch (not shown) within the housing, contacts 42 being provided for electrical connection to an external circuit. As in previouslyproposed apparatus, fluid flow causes movement of the shuttle 30, the resulting change in magnetic field causing the magnetic sensing means to respond. Thus it is possible to detect fluid flow in one direction.

The operation of the flow switch will now be described in more detail.

Firstly, referring to FIG. 1, there will be described the situation in which there is no flow from the inlet (first section 12) to the outlet (fourth section 18). In that case, the shuttle 30 rests under gravity with a bottom flared end of the vaned section 34 resting against the restriction formed by the connection portion 20. It is important to note that there is no seal at this point; thus, although substantial reverse flow cannot take place due to the relatively close fit between the solid cylindrical section 32 of the shuttle 30 and the second section 14 of the bore, downward seepage of liquid can take place to a limited extent. Thus, it is possible for residual liquid remaining above the flow switch to drain downwardly, which is an important advantage in particular applications. In the position of the shuttle 30 shown in FIG. 1, the magnetic sensing means within the detector housing 40 is in a first state. If, for example, a reed switch is used, the switch may be in a conductive state.

Secondly, referring to FIG. 2, there will be described the situation in which there is fluid flow from the inlet (first section 12) to the outlet (fourth section 18). In this open state, the shuttle 30 is lifted by fluid pressure until, if the fluid flow is sufficient, it is retained against the baffle parts of the connecting portion 24. Obstruction to flow is minimized, firstly by virtue of the vanes of the vaned section 34 permitting substantial fluid flow when the vaned section 34 is within the third section 16 of the bore, and secondly as a result of the baffle parts of the connecting portion 24 holding the shuttle 30 clear of the bore. It has been found that the configuration of bore and shuttle shown in FIGS. 1 and 2 can readily be designed such that the flow area at any point along the bore, when the shuttle is in its open state is not less than the area of the first section 12 forming the flow switch inlet; under these conditions, the friction losses during full flow are minimized to less than 10%. In the open position of the shuttle 30, the magnetic sensing means is in a second state; in the case of a reed switch, the relay may be nonconductive.

Accordingly, a flow switch embodying the invention as described above has the advantages that, in its open state, it can present minimal obstruction to fluid flow and, in its closed state, it can allow a certain amount of reverse flow seepage thus permitting fluid drainage back to the inlet side of the flow switch. The fact that the diameter of the shuttle is effectively constant along most of the length of the flow switch (including the diameter of the locus of the vaned section), and that this diameter is only slightly less than the internal diameter of the second bore section, means that the shuttle moves smoothly within the bore and remains in longitudinal alignment, which minimizes the chances of the shuttle sticking within the bore.

The flow switch illustrated in FIGS. 1 and 2 is intended for vertical mounting whereby the closed position of the shuttle as shown in FIG. 1 is effected by gravity. If it is desired to operate the flow switch in some other orientation, a spring may be included to provide the shuttle with a bias towards the inlet such that the shuttle remains in the closed position unless the bias is overcome by a force from fluid flow.

Although an illustrative embodiment of the invention has been described in detail herein with reference to the accompanying drawings, it is to be understood that the invention is not limited to this precise embodiment, and that various changes and modifications can be effected therein by one skilled in the art without departing from the scope and spirit of the invention as defined by the appended claims.

We claim:

1. A flow switch comprising:

a body with a bore extending therethrough, the bore having a relatively narrower section and a relatively wider section downstream of the narrower section;

a member movable within the narrower and wider sections of the bore such that the member is a relatively close fit in the narrower bore section, the member having a first portion which permits only limited fluid flow in the close fit clearance between the first portion and the narrower bore section, and a second portion upstream of the first portion having a flow bypass arrangement whereby substantial fluid flow is possible with the second portion located in the narrower bore section, the member being movable by fluid flow from a closed position to an open position, wherein in the closed position, both the second portion and at least part of the first portion are within the narrower bore section, whereas in the open position, the first portion and a part of the second portion are within the wider bore section thereby allowing fluid to flow; and means for detecting whether the member is in the open position or the closed position;

wherein the flow bypass arrangement defines flow-enabling passages within the second portion of the member.

2. A flow switch according to claim 1, wherein at least the narrower bore section and the movable member are both generally cylindrical.

3. A flow switch according to claim 2, wherein the first portion of the member comprises a first solid cylinder.

4. A flow switch according to claim 1, wherein the detecting means comprises a magnetic arrangement.

5. A flow switch according to claim 4, wherein the detecting means comprises a magnetic reed switch.

6. A flow switch according to claim 4, wherein the detecting means comprises a Hall-effect sensor.

7. A flow switch according to claim 4, wherein the movable member is made of magnetized material.

8. A flow switch according to claim 4, wherein the movable member includes an internal magnet.

9. A flow switch according to claim 1, wherein the flow area of the bore with the member in the open position is not less than the inlet area of the flow switch.

10. A flow switch comprising:

a body with a bore extending therethrough, the bore having relatively narrower and wider sections;

a member movable within the narrower and wider sections of the bore such that the member is a relatively close fit in the narrower bore section, the member having a first portion which permits only limited fluid flow in the close fit clearance between the first portion and the narrower bore section, and a second portion having a flow bypass arrangement whereby substantial fluid flow is possible with the second portion located in the narrower bore section, the member being movable by fluid flow from a closed position to an open position, wherein in the closed position, both the second portion and at least part of the first portion are within the narrower bore section, whereas in the open position, the first portion and a part of the second portion are within the wider bore section thereby allowing fluid to flow; and means for detecting whether the member is in the open position or the closed position; and wherein at least the narrower bore section and the movable member are both generally cylindrical; the first portion of the member comprises a first solid cylinder; the flow bypass arrangement defines flow-enabling spaces in the second portion of the member; and the second portion of the member comprises a second solid cylinder of smaller diameter than that of the first solid cylinder, and a plurality of vanes extending from the second solid cylinder such that the effective external width of the second portion is the same as the diameter of the first portion.

* * * * *